United States Patent [19]

Lederman

[11] Patent Number: 4,631,761

[45] Date of Patent: Dec. 30, 1986

[54] PATIENT TRANSFER TROLLEY

[75] Inventor: Hans J. Lederman, Bridgwater, Great Britain

[73] Assignee: Ganmill Limited, Taunton Somerset, United Kingdom

[21] Appl. No.: 743,494

[22] Filed: Jun. 11, 1985

[51] Int. Cl.[4] ..... A47B 83/04; A61G 7/08

[52] U.S. Cl. ..... 5/81 R; 5/86

[58] Field of Search ..... 5/81 R, 81 A, 86, 433; 414/528

[56] References Cited

U.S. PATENT DOCUMENTS

| | | | |
|---|---|---|---|
| 920,922 | 5/1909 | Csuthy | 5/433 X |
| 3,452,371 | 7/1969 | Hirsch | 5/86 |
| 3,947,902 | 4/1975 | Conde et al. | 5/81 R |
| 3,967,328 | 7/1976 | Cox | 5/81 R |
| 4,087,873 | 9/1978 | Ohkawa | 5/86 X |

FOREIGN PATENT DOCUMENTS

| | | |
|---|---|---|
| 1353093 | 5/1974 | United Kingdom . |
| 1514623 | 6/1978 | United Kingdom . |
| 1581222 | 12/1980 | United Kingdom . |

*Primary Examiner*—J. Karl Bell

*Attorney, Agent, or Firm*—Cushman, Darby & Cushman

[57] ABSTRACT

A patient transfer trolley of the type which is used to transfer patient from a hospital bed to another location such as an operating theatre or an ambulance or a treatment room.

The invention is concerned with a type of trolley which is on wheels and has an endless belt driven by rollers for transferring the patient.

The invention provides such a transfer trolley which operates with the minimum inconvenience to the patient and the minimum apparent motion as far as the patient is concerned.

The trolley has one or more driven wheels (31) and is so arranged that as the endless belt (23) is moved to move the patient, the driven wheels (31) are rotated simultaneously so as to move the trolley at substantially the same speed as the endless belt is moving but in the opposite direction. Thus the patient effectively remains stationary because the movement of the endless belt is exactly compensated for by the movement of the trolley as a whole and the patient is gently moved onto the bed or on the trolley according to the direction of movement of the endless belt.

The driven wheel or wheels of the trolley are completely separate from the wheels on which the trolley is normally moved.

The height of the endless belt is adjustable.

14 Claims, 6 Drawing Figures

PATIENT TRANSFER TROLLEY

This invention relates to a patient transfer trolley of the type which is used to transfer patient from a hospital bed to another location such as an operating theatre or an ambulance or a treatment room.

The invention is concerned with a type of trolley which is on wheels and therefore mobile and has an endless belt driven by rollers for transferring the patient.

An object of the invention is to provide such a transfer trolley which operates with the minimum inconvenience to the patient and the minimum apparent motion as far as the patient is concerned.

In accordance with the present invention the trolley has one or more driven wheels and is so arranged that as the endless belt is moved to move the patient, the driven wheels are also rotated so as to move the trolley at substantially the same speed as the endless belt is moving but in the opposite direction. Thus the patient effectively remains stationery because the movement of the endless belt is exactly compensated for by the movement of the trolley as a whole and the patient is gently moved onto the bed or on the trolley according to the direction of movement of the endless belt. The movement may be imparted to the conveyor manually or be means of an electric motor. The drive mechanism may include a worm shaft, the worm driving a worm wheel which rotates a roller to move the belt, the shaft also driving a gear train by which one or more wheels of the trolley are driven. The gear train may include bevel gears connecting the drive shaft to a second shaft carrying a worm which drives a worm gear attached to a wheel of the trolley.

The driven wheel or wheels of the trolley may be completely separate from the wheels on which the trolley is normally moved. The driven wheel(s) may be journalled in a pivoted housing so that they may be lifted clear of the ground or brought into contact with the ground at will. When the driven wheel is brought into contact with the ground it will drive the trolley.

Preferably the transfer belt is supported on a table which is vertically adjustable relatively to the base of the trolley. The vertical adjustment may be achieved either manually or through an electrical motor and may comprise a jack or a lead screw and nut at each end of the trolley to raise and lower the table. The jack or lead screw drives may be interconnected by a common shaft and driven by a single motor or single manual lever. A common motor may be employed to effect both vertical adjustment of the table and movement of the belt conveyor and trolley driven wheel(s).

If a single driving motor or driving handle is used it may be clutchable at will either to the jacing shaft or to the drive shaft for the belt and wheels.

The table carrying the belt conveyor is preferably cantilevered from one end of the trolley on a vertical post which may also provide the sliding bearing for vertical adjustment of the table.

Figure 1:
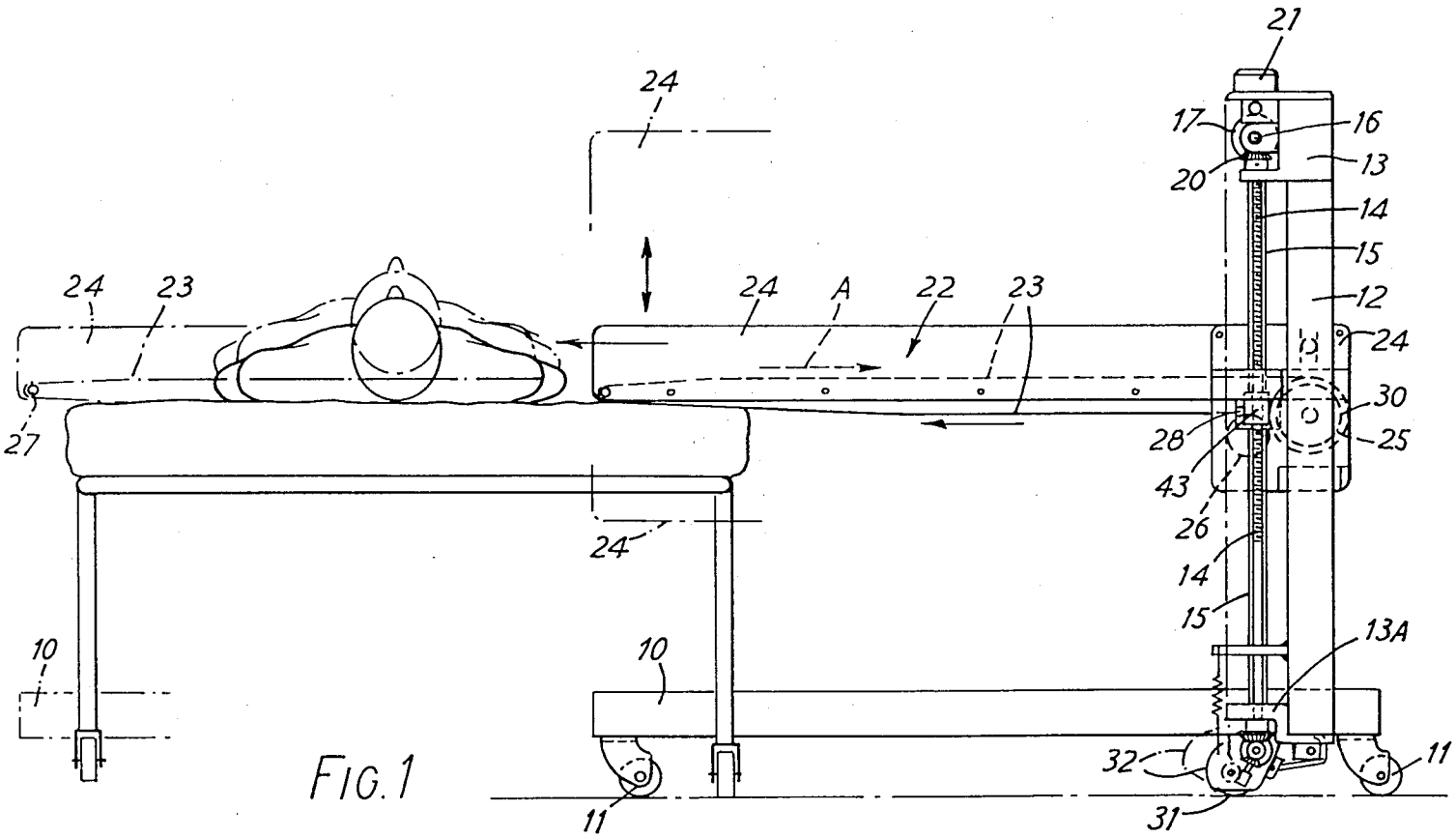
FIG. 1 is a diagrammatic side elevation with parts broken away to illustrate the gears etc. of a patient transfer trolley embodying the present invention.
Figure 2:
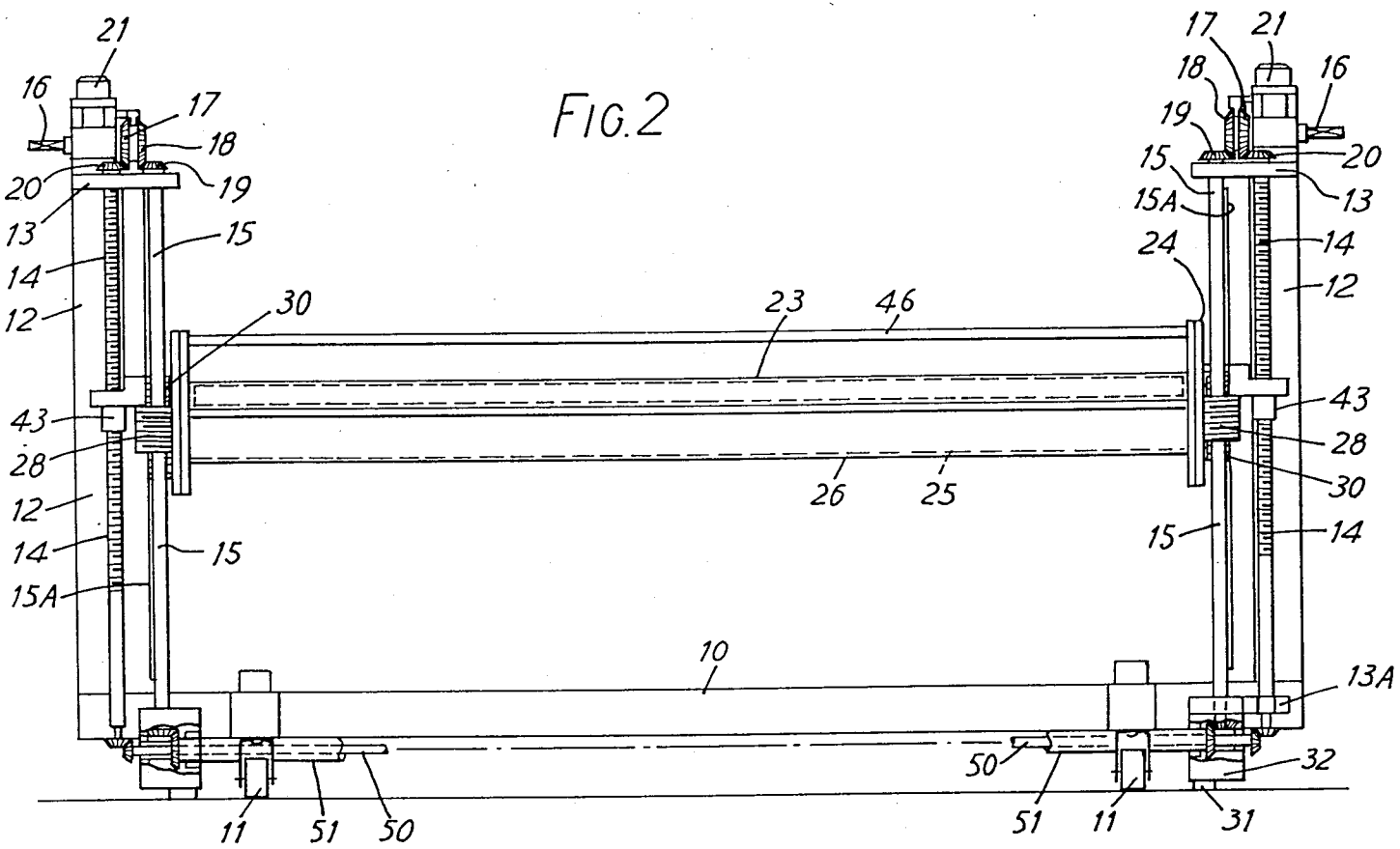
FIG. 2 is a front elevation of the same patient transfer trolley.

Considering first FIGS. 1 and 2, the patient transfer trolley shown in the drawings comprises a base 10 carried on conventional castors 11 and having at one end a pair of vertical posts 12 from which a transfer table and belt is cantilevered.

The posts 12 each have at their upper end a journal bracket 13. A vertical worm shaft 14 is journalled at its top end in bracket 13 and at its lower end in a bracket 13A attached to the base 10. Also journalled between the brackets 13 and 13A is a power drive shaft 15. The power is supplied either manually or from an electric motor via power input shaft 16 which can be moved axially so as to shift either bevel gear 17 into contact with bevel gear 20 so as to drive the worm shaft 14 or so that bevel gear 18 comes into contact with bevel gear 19 to drive the power shaft 15. The movement of shaft 16 axially is effected by a clutch mechanism, to be described in detail later, operable by a clutch knob 21. The vertical posts 12 carry, in cantilever fashion, a table 22 which supports an endless transfer belt 23. The table 22 is carried on a table support plate 24. There is one plate associated with each of the posts 12. Between the plates 24 are journalled a drive roller 25 and a tension roller 26 round which the belt 23 is wrapped. Between end plates 24 of the table 22 at the leading edge are rollers 27. The drive roller 25 is driven by a worm 28 journalled between bearings attached to a plate 24. The worm 28 is slidable up and down but driven by a key 15A on the drive shaft 15 but can only rotate with it.

Thus when the drive shaft 15 is rotated it rotates the worm which in turn drives via a bevel gear 30 the drive roller 25. This in turn moves the endless belt 23 in one direction or the other according to the direction of drive. The endless belt may be of steel or aluminium with a rubber layer banded on to it.

Figure 4:
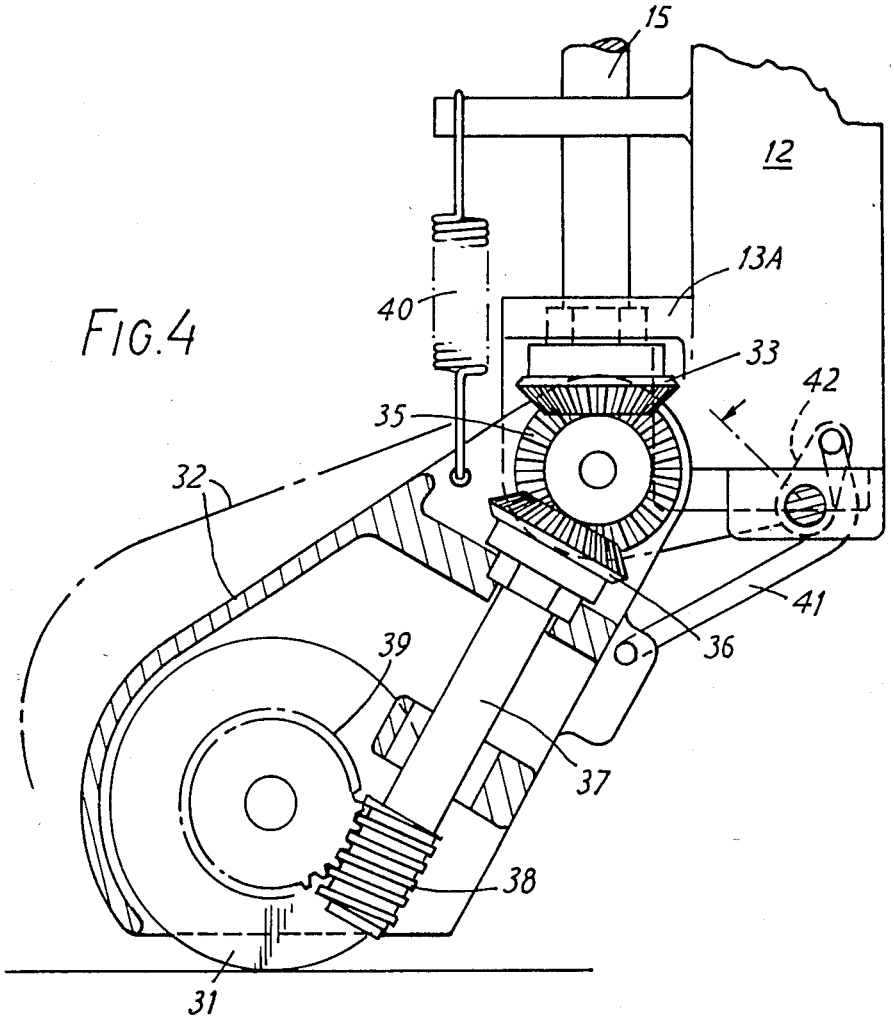
FIG. 4 is an enlarged elevation partly in section of the lower portion of the right-hand section of FIG. 1 showing a drive wheel and the mechanism for driving it.

At the bottom end of the drive shaft 15 is a bevel pinion 33 which is arranged through gearing to drive a driving wheel 31 journalled in a pivoted drive wheel housing 32 (see FIG. 4).

As shown best in FIG. 4 the pinion 33 drives, through a crown wheel 35 a further bevel gear 36 carried on a shaft 37 journalled in the housing 32 and having at its end a worm 38 driving a worm wheel 39 which in turn drives the driving wheel 31.

This driving wheel 31 may be brought into operation, when required, by turning the housing 32 anticlockwise, as shown in FIG. 4, against the tension of spring 40 until the overcentre mechanism comprising angled strut 41 and lever 42 goes overcentre so as to lock the wheel in the ground engaging or driving position. There are of course two such driving wheels 31 one on each side of the transfer trolley. When the driving wheels 31 engage the ground the lift the castors 11 clear of the ground at the right-hand end (as seen in FIG. 1) of the trolley. Thus when the drive shaft is driven it not only moves the endless transfer belt but also moves the trolley as a whole but in the opposite direction to the movement of the endless transfer belt and at approximately the same speed.

The height of the endless transfer belt and its table may be adjusted by engaging the appropriate bevelled gear with the worm shaft 14. On the worm shaft 14 is a captive nut 43 which is carried by the table support plate 24. There are two such captive nuts, one on each side of the transfer table, as seen in FIG. 2, Thus when the worm shaft 14 is rotated it will raise or lower the table 22 by virtue of movement of the captive nuts and the plates, and table together up and down the worm shafts. This enables the height of the patient relative to be adjusted so as to bring the transfer belt exactly into line with the place to which the patient is to be transferred but slightly above it so that the whole trolley may be moved as shown in FIG. 1 into a position to transfer the patient onto the bed or the like.

Figure 5:
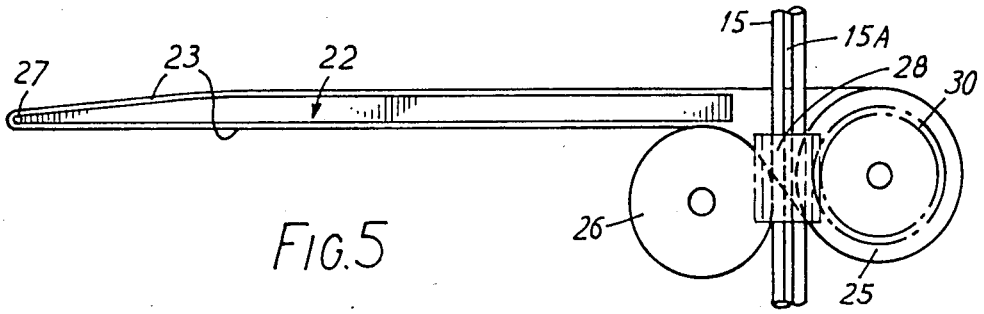
FIG. 5 shows diagrammatically the way in which an endless transfer belt by which the patient is transferred, is driven.

The movement of the transfer belt 23 is shown diagrammatically in FIG. 5 from which the drive roller 25 and tension roller 26 together with the worm 28 and worm wheel 30 can be clearly seen.

Figure 3:
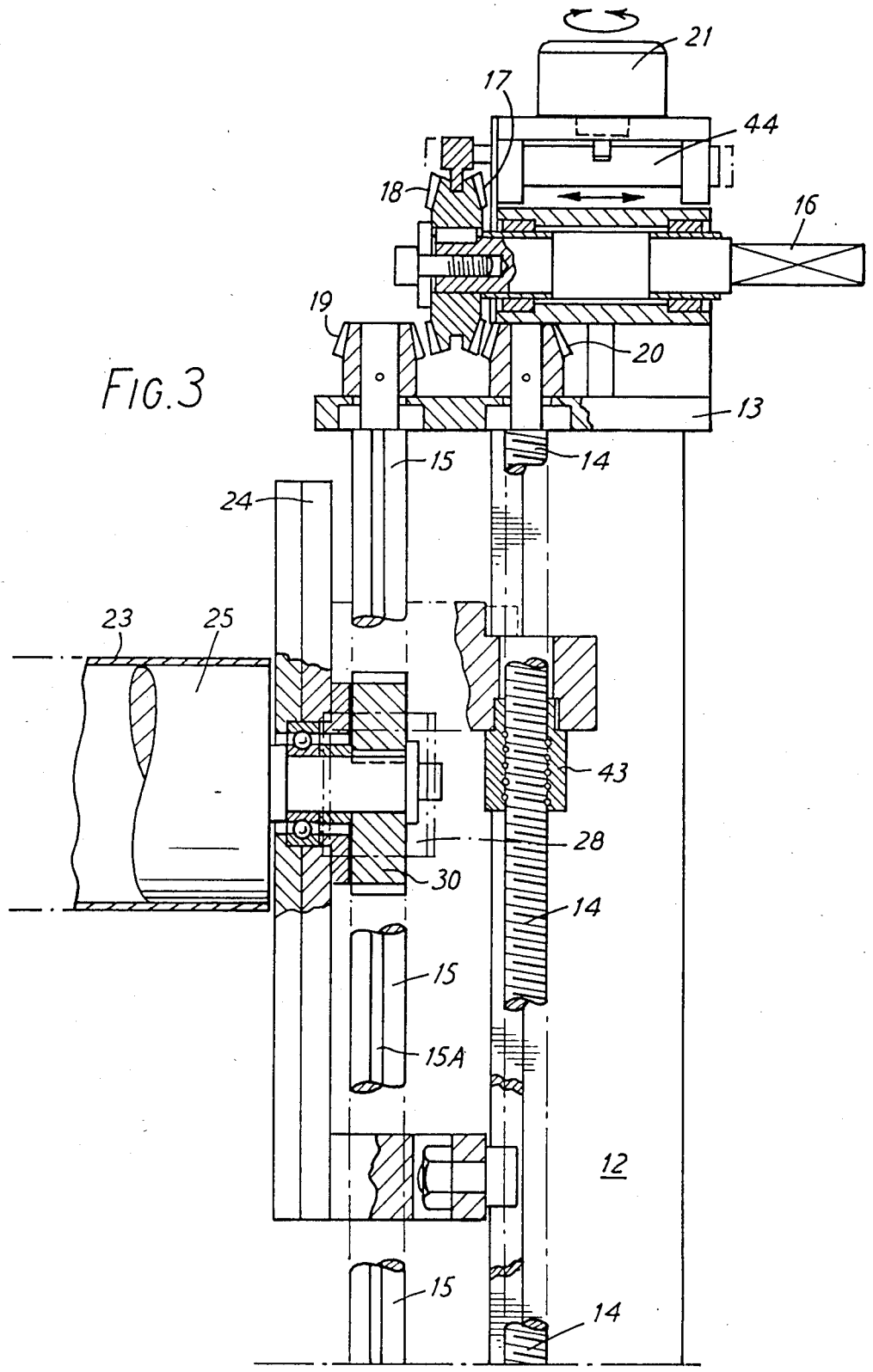
FIG. 3 is an elevation with parts in section on an enlarged scale of the upper end of the right-hand portion of FIG. 2 showing the drive shafts and gearing clutch etc. by which the patient transfer trolley is operated.

The driving gears and clutch mechanism are illustrated in rather more detail in FIG. 3. When the clutch operating knob 21 is turned it moves a lay shaft 44 to the right or left as shown and this in turn moves combined gears 17 and 18 so as to engage either of pinions 19 and 20. The combined gears 17 and 18 are journalled on one end of the shaft 16 which acts as the driving shaft thus according to the movement of the knob 21 either the drive is engaged through pinion 19 with main vertical drive shaft 15 or it is engaged through pinion 20 with worm shaft 14.

To enable the operations of the transfer system to be effected equally well from either side of the bed there are of course two input drive shafts 16 (see FIG. 2). To bring the drive equally to either side of the bed there is cross connecting system of shafts so that the movements of the drive shaft 15 and worm shaft 16 are transferred through the cross connecting shafts 50,51 and bevel gears to the corresponding drive shaft 15 and worm 16 in the opposite post 12.

It will be appreciated that, although not shown in complete detail in the drawings, the right-hand post 12 and all of its mechanism is completely duplicated in the left-hand post 12.

In use of this transfer system the patient can be transferred either from the transfer table to a bed or from a bed to a transfer table.

As shown in FIG. 1 if the patient is lying on the bed the transfer is brought to the position shown in FIG. 1 and the motor is started or the handle is turned in order to move the transfer belt so that its top surface moves in the direction of the arrow A (from left to right in FIG. 1) and at the same time the driving wheels 31 are driven simultaneously so as to move the whole transfer table and system from right to left at approximately the same speed as the transfer belt is moving from left to right. Thus the patient is very gradually moved onto the transfer belt without any real sense of movement because the transfer belt as it moves from left to right is being bodily moved with the transfer table from right to left at approximately the same speed.

The transfer of a patient from the transfer table to a bed or to an operating table or stretcher etc. is carried out by reversing this procedure. A safety device may be incorporated, not shown, so that when the patient reaches a certain position on the transfer table the drive is automatically inhibited either by stopping the driving motor or by mechanically locking the drive.

A rail may be provided, as shown at 46 to prevent the patient being inadvertently pushed off the right-hand side of the transfer table as seen in FIG. 1.

All mechanical parts will be enclosed in a suitable casing, omitted in the drawings for clarity. The modified patient transfer trolley shown in FIG. 6 comprises a base portion 10*a* which carries a box 10*b* containing batteries and control mechanism etc. The base portion rests on a pair of struts 52, 53 supported by casters 54, 55, 56 and a fourth caster not shown.

The table 57 and endless transfer belt 58 are supported between vertical posts 59, 60 as in the previous description.

The trolley has driven wheels 31 which are arranged in exactly the same way as previously described with the same kind of drive mechanism, gearing etc. All the details of the drive, the gearing, the method of raising the table etc. are the same as previously described.

In this embodiment of the invention there is a guard rail 61, 62, 63 which extends round three sides of the patient transfer table 57 and transfer belt 58. This is merely to prevent the patient falling off the transfer table. At the back of the table 57 there is a second rail 64 which is mounted on microswitches (not shown) so that if the patient contacts the rail 64 the microswitches automatically cut off the drive to the transfer belt 58.

There is another safety mechanism incorporated in that a safety bar 65 extends laterally across the base of the trolley and there are vertical extensions of the safety bar 66 and 67 so arranged that if any part of the safety bar comes into contact with the bed or with any other fixed object the movement of the trolley is automatically stopped because the safety bars 65,66,67 are connected to microswitches in the motor circuit driving the trolley.

There is an arrangement for manual operation of the trolley consisting of a cranked handle 68 which may be set either to move the trolley bodily or to rotate the rollers which drive the transfer belt 58 and the setting of this to achieve either drive is arranged through a clutched control device 69.

When operated electrically the trolley may be operated by remote control by using a flying lead 70 with a hand control box 71 attached to it, the hand control box being provided in conventional manner with all the controls necessary to move the trolley and to raise and lower the table 57. The flying lead enables the nurse or other person operating the table to stand on the side of the bed remote from the trolley so as to steady the patient as the patient moves onto the trolley.

Power may be supplied for electrical operation either from a rechargeable battery in the box 10*b*. This battery being carried on the unit enables the unit to be completely self contained and the battery charger may be included so that the battery carried on the unit may be recharged from the mains without even removing it from the unit.

The hand set 71 may include an infinitely variable speed control, reversing control and on/off switch in addition to the controls mentioned.

The belt tension. The belt 58 may be adjusted by a simple tensioning device not shown.

The further safety device may be provided in the form of a foot pedal 72 which will engage or disengage the drive. A further foot pedal 73 may be provided to engage a directional lock for easy steering of the unit or to brake the unit when stationary or to allow the castors to free-wheel.

Figure 6:
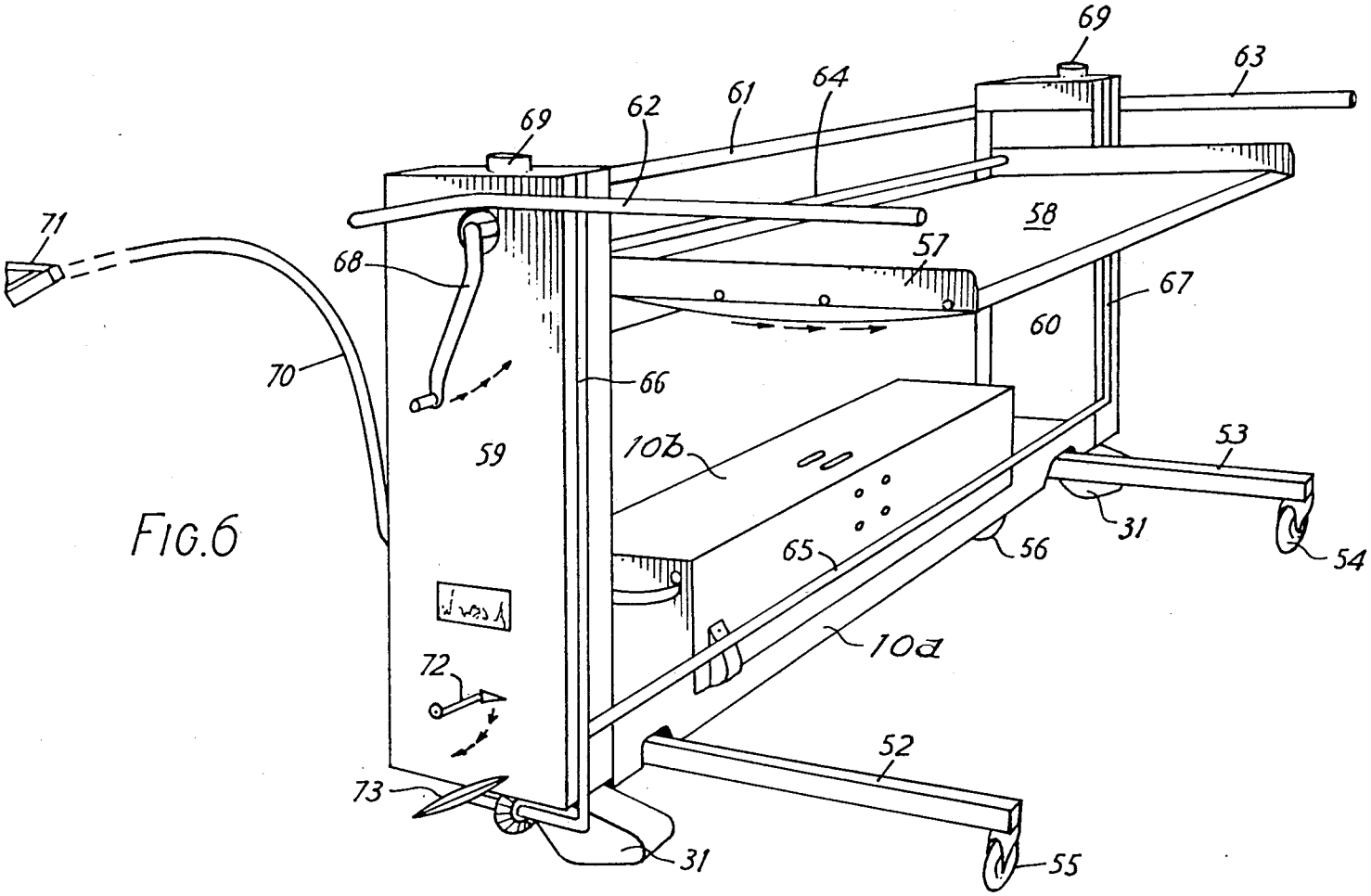
FIG. 6 is a perspective view of a modified form of the patient transfer trolley shown in FIGS. 1 to 5.

Those parts of the mechanism and drive etc. not described in relation to FIG. 6 may be taken to be the same as in previous FIGS. 1 to 5 and any of the features shown in any of these previous figures may be incorporated in the trolley shown in FIG. 6. Equally any of the features shown in FIG. 6 may be incorporated in the trolley shown in FIGS. 1 to 5.

The endless belt 23 is supported on a reinforced stainless steel table but the stainless steel table may be replaced by a table made of plastics material or carbon fibre material so as to allow X-rays to penetrate the table. With this arrangement a patient may be X-rayed on the transfer trolley without the need to transfer the patient to a special X-ray table.

Three possible constructional materials for this table are:

1. To use a machinable resin bonded paper or woven material or glass reinforced fibre/polyester;
2. To use two vacuum formings of polystyrene or polycarbonate which are identical and sandwiched between is a hard foam of plastics material for added support;
3. Carbon fibre.

I claim:

1. A patient transfer trolley, wheels supporting said trolley, means rotatably mounting rollers on said trolley, means to drive said rollers, an endless belt mounted on and driven by rollers, for transferring the patient, means for driving at least one trolley wheel, so arranged that as the endless belt is moved to move the patient, the driven wheels are also rotated so as to move the trolley at substantially the same speed as the endless belt is moving but in the opposite direction.

2. A trolley according to claim 1 in which said means to drive said rollers is manual means.

3. A trolley according to claim 1 and in which said means to drive said rollers is an electric motor.

4. A trolley according to claim 1 or claim 2 and in which the drive means includes a worm shaft, a worm in said shaft and a worm wheel, the worm driving the worm wheel to rotate said rollers to move the belt and comprising a gear train by which at least one of said wheels of the trolley are driven, said gear trains also being driven by the worm shaft.

5. A trolley according to claim 4 in which said gear train includes bevel gears connecting the drive shaft to a second shaft carrying a worm which drives a worm gear attached to a wheel of the trolley.

6. A trolley according to claim 1 and in which the driven wheel or wheels of the trolley are completely separate from the wheels on which the trolley is normally moved.

7. A trolley according to claim 6 and comprising a housing pivoted on the trolley, the driven wheel is journalled in the pivoted housing so that it may be lifted clear of the ground or brought into contact with the ground at will.

8. A trolley according to claim 7 in which the trolley has conventional castors in addition to the driven wheel when the driven wheel is brought into contact with the ground it will drive the trolley and in this position at least a pair of the trolley's conventional castors are raised clear of the ground.

9. A trolley according to claim 1 including a table, the transfer belt being supported on the table which is vertically adjustable relatively to the base of the trolley.

10. A trolley according to claim 9 in which the vertical adjustment may be effected by a jack at each end of the trolley to raise and lower the table.

11. A trolley according to claim 8 in which the jack drives are interconnected by a common shaft and driven by a single motor.

12. A trolley according to claim 7 in which a common motor is employed to effect both vertical adjustment of the table and movement of the belt conveyor and trolley driven wheel.

13. A trolley according to claim 1 and in which the table carrying the belt conveyor is cantilevered from one end of the trolley on a vertical post which also provides the sliding bearing for vertical adjustment of the table.

14. A trolley according to claim 1 in which the endless belt is supported by a table made of plastics or carbon fibre material so as to enable a patient to be X-rayed on the trolley.

* * * * *